US006829791B2

(12) United States Patent
Roepke

(10) Patent No.: US 6,829,791 B2
(45) Date of Patent: Dec. 14, 2004

(54) SYSTEM AND METHOD FOR RETRACTABLE FURNITURE UNIT

(75) Inventor: Emmett James Roepke, 7 Cornelia St., #4, New York, NY (US) 10014

(73) Assignee: Emmett James Roepke, New York, NY (US)

( * ) Notice: Subject to any disclaimer, the term of this patent is extended or adjusted under 35 U.S.C. 154(b) by 0 days.

(21) Appl. No.: 10/351,515

(22) Filed: Jan. 27, 2003

(65) Prior Publication Data

US 2004/0143901 A1 Jul. 29, 2004

(51) Int. Cl.[7] ..... A47C 17/84
(52) U.S. Cl. ..... 5/10.1; 5/10.2; 5/905
(58) Field of Search ..... 5/10.1, 10.2, 905

(56) References Cited

U.S. PATENT DOCUMENTS

| | | | | | |
|---|---|---|---|---|---|
| 614,377 | A | * | 11/1898 | Evans | 5/10.2 |
| 2,730,213 | A | * | 1/1956 | Mason et al. | 477/21 |
| 2,968,048 | A | * | 1/1961 | Roberge | 5/10.1 |
| 4,058,860 | A | * | 11/1977 | Daidone | 5/10.1 |
| 4,586,206 | A | | 5/1986 | Singer | |
| 4,631,763 | A | | 12/1986 | Singer | |
| 4,837,877 | A | * | 6/1989 | Hamada et al. | 5/10.2 |
| 4,853,989 | A | | 8/1989 | Garcia | |
| 5,020,169 | A | * | 6/1991 | Hamada et al. | 5/10.2 |
| 5,101,523 | A | | 4/1992 | Bright | |
| 5,363,520 | A | * | 11/1994 | Lyne, Jr. | 5/11 |
| 6,401,276 | B1 | | 6/2002 | Sherman | |
| 6,507,962 | B2 | * | 1/2003 | Thurston | 5/10.1 |
| 2002/0074910 | A1 | | 6/2002 | Reppas et al. | |
| 2002/0148041 | A1 | | 10/2002 | Sherman | |

* cited by examiner

*Primary Examiner*—Michael F. Trettel
(74) *Attorney, Agent, or Firm*—Hunton & Williams LLP

(57) ABSTRACT

A retractable bed is disclosed which can be automatically raised and lowered in a vertical fashion. The retractable bed includes a frame for holding a mattress; and means for raising and lowering said bed through vertical displacement, such as one or more motors. When the bed is in the lowered configuration it will come into contact with the floor thereby permitting a person to sleep on the bed. When the bed is in the raised configuration it will be near the ceiling thereby permitting a person to pass under the bed. The means for raising and lowering said bed, such as one or more motors, provides an automated and convenient way to take the bed down and to put it away.

23 Claims, 8 Drawing Sheets

SYSTEM AND METHOD FOR RETRACTABLE FURNITURE UNIT

FIELD OF THE INVENTION

The present invention generally relates to furniture structures and, more particularly, to a mechanically retractable furniture unit.

BACKGROUND OF THE INVENTION

The trend of so-called urban flight has reversed itself in the last twenty years, with individuals and families moving back into urban areas from the suburbs and beyond. Most major cities have enjoyed something of a renaissance as long-neglected downtown districts have been revitalized and commercialized. In short, the American city is being celebrated with great vigor by those who only a few decades ago were fleeing it in droves. Washington, D.C., for example, has seen its "old downtown" area redeveloped and its population has spiked over the last decade. New York City, the jurisdiction some considered "ungovernable" only twenty years ago, has enjoyed a spectacular resurgence as the financial and cultural capital of urban America.

The back-to-the-city trend has been facilitated by redevelopment to accommodate new residents—some individuals, some couples, and some families. In some cases, former commercial districts have been mixed with residential construction. In some cases, manufacturing or similar commercial structures have been converted into trendy apartments, condominiums, or co-opts. That being said, space is still a premium in urban environments and many residents find it a challenge to comfortably furnish their dwellings with the space available. This issue can be critical in small apartments, such as studio apartments.

A variety of design trends and systems have been developed as a result of the space issue in urban residential dwellings. For example, lofts which provide an elevated area for a bed or couch are found in some apartments. Futons function as a (typically uncomfortable) bed when folded out and as a (typically unglamorous) couch when folded up. Convertible sofas provide improved functionality and aesthetics by also providing a bed in one configuration and a sofa in another. The prior art has also produced beds which fold up into the wall.

Each of these prior art approaches to the space problem has its drawbacks. Typical lofts obviously require special construction. This can entail significant cost. Also, many average sized rooms are simply not big enough to accommodate a loft.

Futons provide limited functionality and comfort as a bed. As the typical person who has spent more than a few weeks sleeping on a futon can attest, sleeping on a futon is simply not the same experience as sleeping on a standard construction full-size bed.

Beds that fold up or pivot into the wall are an improvement, but a fair amount of horizontal space is sacrificed. The two or three feet that must be given up may be significant, even intolerable, in apartments have rooms with tight dimensions.

U.S. Pat. No. 4,853,989 to Garcia discloses a retractable bed that folds up into a false ceiling. The Garcia approach requires a complex folding structure with at least two pivot points that requires the use of a non-standard bed. Also, because the Garcia system requires rotation about two axes to open the bed, it is not readily amenable to an automated mechanism for opening and closing this complex structure.

Other drawbacks and disadvantages exist in the prior art.

SUMMARY OF THE INVENTION

According to one embodiment, the present invention is directed to a retractable bed that can be automatically raised and lowered in a vertical fashion. The retractable bed includes a frame for holding a mattress; and means for raising and lowering said bed through vertical displacement, such as one or more motors. When the bed is in the lowered configuration it will come into contact with the floor thereby permitting a person to sleep on the bed. When the bed is in the raised configuration it will be near the ceiling thereby permitting a person to pass under the bed. The means for raising and lowering said bed, such as one or more motors, provides an automated and convenient way to take the bed down and to put it away.

According to one further aspect of the invention, the retractable bed uses a motor that is fixably situated away from the bed. In this embodiment, the motor is controlled to move the bed up and down while the motor remains stationary.

According to another aspect of the invention, the retractable bed uses a motor, preferably two motors, that are integrated with or coupled to the bed/frame. In this embodiment, the motor(s) is controlled to move the bed up and down, the motor(s) moving with the bed.

Other embodiment, variations, and enhancements are disclosed.

The advantages of the present invention are numerous. The invention greatly mitigates the space problem in dwellings with small rooms, allowing the resident to take full advantage of the available area of the room during the day. The invention does not require complex, non-standard structures. In fact, standard frames/mattresses can accommodate the invention. The solution provided by the invention is also aesthetically pleasing to the eye.

Accordingly, it is one object of the invention to address the space problem presented by dwellings with small rooms.

It is another object of the invention to provide a bed that can be automatically taken out when it is needed and put away when it is not needed.

It is yet another object of the invention to provide a retractable bed that readily accommodates standard frames and bed sizes.

These and other objects of the invention are addressed by the written description and figures contained herein.

DETAILED DESCRIPTION OF THE INVENTION

Figure 1:
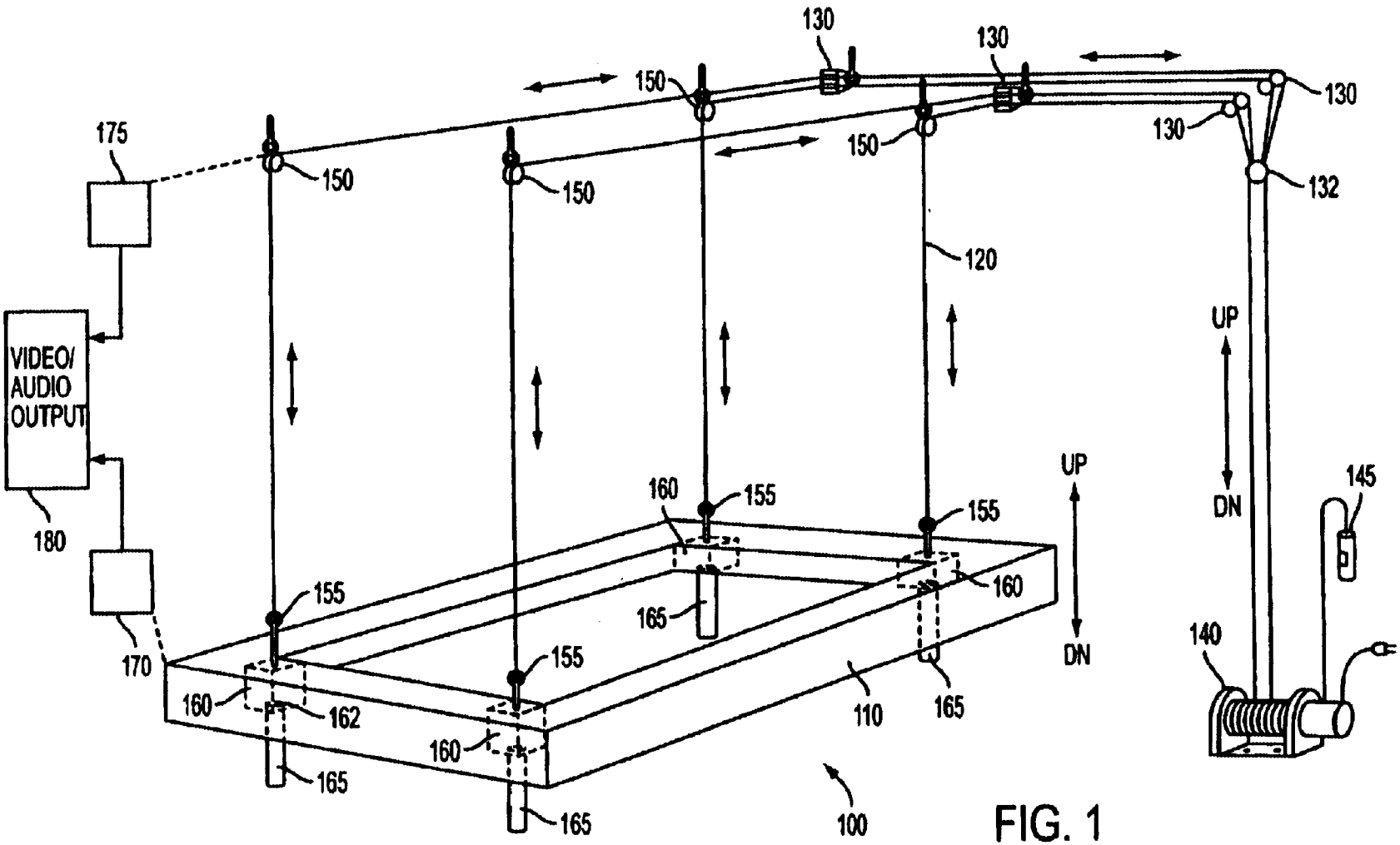
FIG. 1 is a diagram of a retractable bed system in the lowered configuration according to an embodiment of the invention.

FIG. 1 is a block diagram of a retractable bed system 100 according to an embodiment of the invention. Retractable bed system 100 includes frame 110; support lines 120; first blocks 130; double block 132; raising/lowering means 140; remote control unit 145; second blocks 150; eye hooks 155; internal blocking 160; flange 162; and legs or support blocks 165.

Generally, the operation of retractable bed system is as follows. Raising/lowering means 140 is operated or controlled using remote control unit 145 in order to raise or lower frame 110. A block structure comprising first blocks 130, double block 132, second blocks 150, and support lines 120 is used to transfer the load of the frame (and related structure) to raising/lowering means 140. Accordingly, when raising/lowering means 140 is operated to raise the bed the support lines 120 are drawn in or pulled in order to raise frame 110 from the floor to a position adjacent to the ceiling (not shown). When raising/lowering means 140 is operated to lower the bed the support lines 120 are extended or paid out in order to lower frame 110 from a position adjacent to the ceiling down to the floor. In either instance, the frame 110 is vertically displaced up or down to place the bed in the desired position.

Raising/lowering means 140 preferably comprises a electric motor that pays out or takes in support lines 120. According to one embodiment, raising/lowering means 140 is a step-type motor that precisely controls movement of frame 110, although most compact commercial grade motors will suffice. According to one embodiment, raising/lowering means 140 is an electric hoist manufactured by Central Machinery (Item #44006 listed as 12SB).

Raising/lowering means 140 is fixably attached separate from the bed, such as to the floor or a wall. Raising/lowering means 140 will be stationary as the frame 110 is being raised/lowered.

Remote control unit 145 comprises a device for remotely controlling raising/lowering means 140. Remote control unit 145 may be connected to raising/lowering means 140 by a cord or line, although preferably it is not physically attached. Thus, preferably remote control unit communicates with raising/lowering means 145 through radio signals, infrared signals, or acoustic signals that obviate the need for a physical connection. Remote control unit 145 could also be a conventional electrical switch, such as one mounted on the wall.

Support lines 120 support the load of frame 110 and associated components. Support lines 120 can be any wire, cable, tether or the like with sufficient strength and reliability to support the load. According to one embodiment, support lines 120 are nautical structure lines, for example, nautical nylon line by West Marine (⅝ inch diameter) or aircraft wire (⅛ inch diameter).

Frame 110 is the structural component of the bed. According to one embodiment, frame 110 is a standard-type bed frame (e.g., twin, king, queen, or other standard size) that has been adapted for the present invention. According to another embodiment, frame 110 is specially designed for the present invention. For example, frame 110 may be built using light material, such as a light wood, aluminum, plastic or other synthetic, in order to reduce the load on the system. According to one approach, frame 110 is custom built from plywood and pine wood. According to another approach, frame 110 is built using light weight metal plates and metal wire structure covered in polyurethane foam mold. According to this latter approach, the frame may be built in two sections that allow for easy transportation and then assembly on-site using a simple lock system. The frame would be bolted at the width (rather than the length) so that the motors are not affected (see FIG. 5 embodiment).

First blocks 130 and second blocks 150 comprise blocks for transferring the load between raising/lowering means 140 and frame 110. Preferably, first blocks 130 are double blocks mounted on eye hooks (attached to the ceiling), while second blocks 150 are single blocks mounted on eye hooks (attached to the ceiling). According to one approach, first blocks 130 and second blocks 150 are West Marine nautical blocks at ⅝" diameter. Note that the term "blocks" comprises pulleys as commonly understood.

Double block 132 transfers the load from the single line emanating from raising/lowering means 140 to a pair of lines routed to frame 110. According to one approach, double block 132 is a West Marine nautical block at ⅝" diameter.

Eye hooks 155 are standard eye hooks which in this application are used to couple blocks to the ceiling or wall, or to couple lines to the bed frame. Other suitable means for connecting blocks or the lines could be employed.

It should be understood by the skilled artisan that alternative configurations of the block arrangement are readily accommodated, and do not depart from the spirit and scope of the present invention. For example, multiple lines could emanate from raising/lowering means 140, rather than a single line.

Internal blocking 160 and flange 162 provide structure within the frame 110 for coupling the lines to the frame and for coupling legs or support blocks 165 to the frame. Preferably, internal blocking 160 is constructed of wood, although other materials, such as metal, plastic, or other synthetics could be used.

Legs or support blocks 165 provide the interface between the frame 110 and the floor (not shown). Preferably, legs or support blocks 165 are legs as commonly understood, although rectangular support blocks providing similar functionality and a modern aesthetic could be employed. Legs or support blocks 165 can be removable. For example, they may be threaded so that they can be inserted and removed by screwing/unscrewing. Other means for permitting easy insertion/removal of legs or support blocks 165, while reliably holding them while in place, can be employed, such as fixed mechanical legs that are in threaded sockets that lock into place in the open and closed positions. Ideally, the four legs for the bed would be mechanical and would go up and down (open and close) with the motor.

Legs or support blocks 165 can also be extendable/retractable. For example, there may be one or more motors, such as one motor for each leg, for causing the legs/support blocks 165 to extend (for when the bed is to be in the lowered configuration) and for causing legs/support blocks 165 to retract (for when the bed is in the raised configuration). Thus, element 162 of FIG. 1 may further comprise a motor for extending/retracting the lee. According to one aspect, remote control device 145 can be used to control the extension/retraction of legs/support blocks 165. According to another aspect of the invention, legs/support blocks can be automatically caused to extend/retract when the frame 110 is being lowered/raised. For example, remote control device 145 may automatically cause the legs/support blocks 165 to retract when the user initiates raising, and to extend when the user initiates lowering. This would prevent inadvertent damage to the frame/floor in certain scenarios.

Whether the legs/support blocks 165 are removable or retractable, means for covering an orifice exposed when the legs are removed/retracted may be provided. For example, covers 185 (see FIG. 3) of the appropriate geometry could be inserted over the holes. These covers could be manually inserted by the user or they could be automatically inserted (e.g., slid over the hole under the control of a small motor).

According to another aspect of the invention, means for raising and lowering 140 may be adapted to allow a maximum amount of displacement so as to avoid damage to the ceiling or the floor. For example, such means may comprise a motor 140 that is programmable, or which otherwise can be set, so that the frame 110 is not raised beyond the point where it should be raised (thereby avoiding damage to the ceiling), and/or so that the frame is not lowered beyond the point where it should be lowered (thereby avoiding support lines 120 sagging and/or the frame 110 not fully resting on the floor).

To accommodate the aforementioned, the retractable bed of the present invention may include at least one sensor 170 for determining when the bed is in the lowered configuration. There may be at least one sensor 175 for determining when the bed is in the raised configuration. Such sensors may be mechanical devices or optical devices (laser sensors, well understood in the art) or electrical devices (e.g., switches) for measuring displacement of the unit. Additionally, the unit may also include an output device 180 for outputting a visual or acoustic indicia that the bed is in the lowered configuration. The unit may include an output device 180 for outputting a visual or acoustic indicia that the bed is in the raised configuration. The aforementioned output devices may provide an output (visual indicia or acoustic "beep") to indicate that the bed has arrived at the raised/lowered configuration, and/or provide an output (e.g., an emphasized visual indicia or a louder beep) to indicate when raising/lowering means 140 is attempting to raise/lower the frame 110 beyond the point at which it should be raised/lowered.

According to yet another aspect of the invention, one or more light fixtures 190 (see FIG. 3) may be attached for use when the unit is in the raised configuration. For example, such a light fixture can be inserted into the orifice exposed when a leg/support block 165 is removed. Alternatively, a light fixture 195 (see FIG. 3) may simply be removably attached (e.g., through a clamp) to the frame when the bed is in the raised position. Or the light fixture may be permanently attached to or integrated into the bottom of the frame.

It should be understood that the variations and enhancements discussed above regarding legs/support blocks 165 (e.g., removable or retractable), control over displacement, sensors regarding displacement, output devices regarding displacement, and integration of light fixtures, can be employed for the various embodiments of the retractable bed discussed herein. In particular, such enhancements and variations can be readily employed in connection with the alternative configuration of the invention discussed below in conjunction with FIGS. 5-9.

Figure 2:
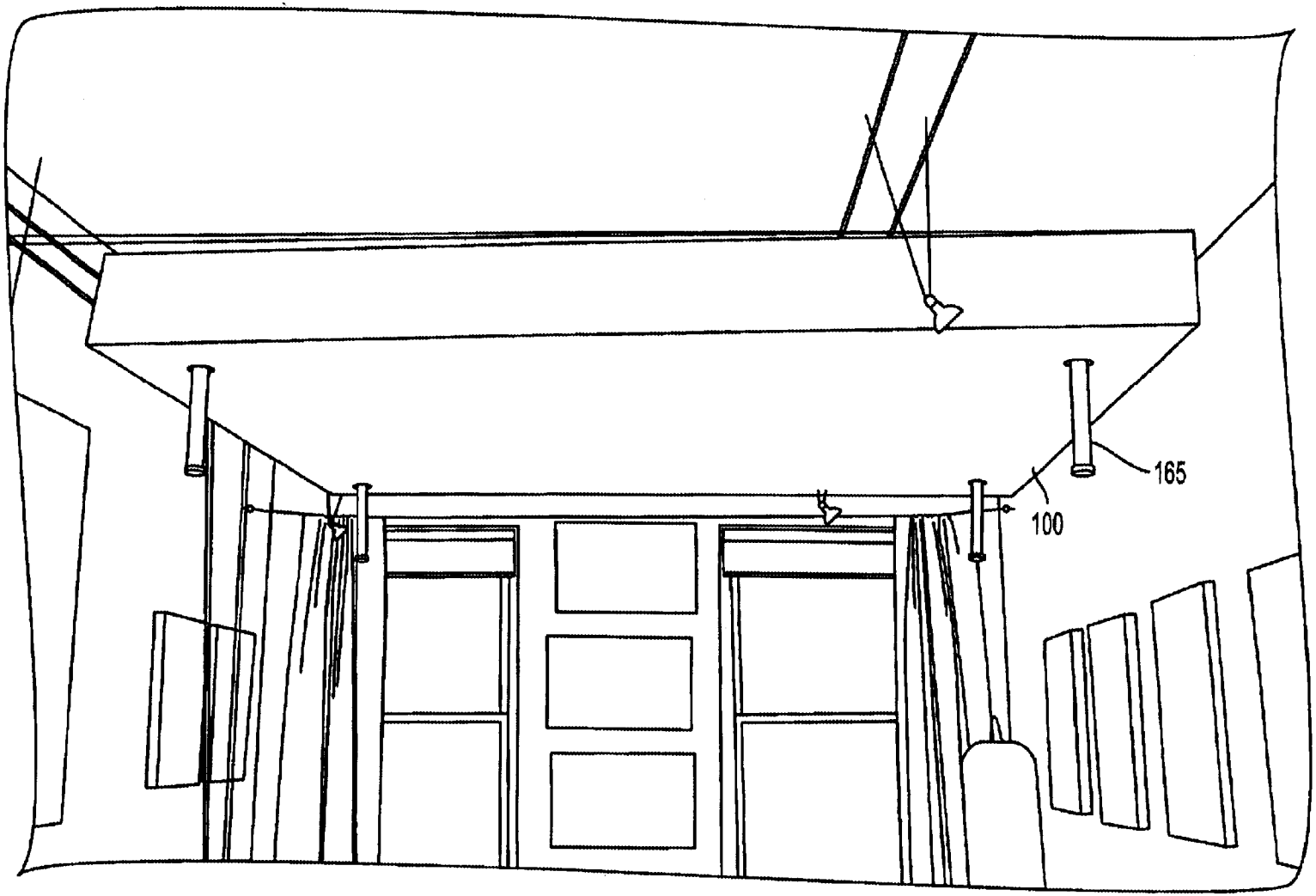
FIG. 2 is a diagram of a retractable bed system in the raised configuration according to an embodiment of the invention.

FIG. 2 is an illustration of the retractable bed system 100 in the raised position. Legs 165 are not removed or retracted in this illustration.

Figure 3:
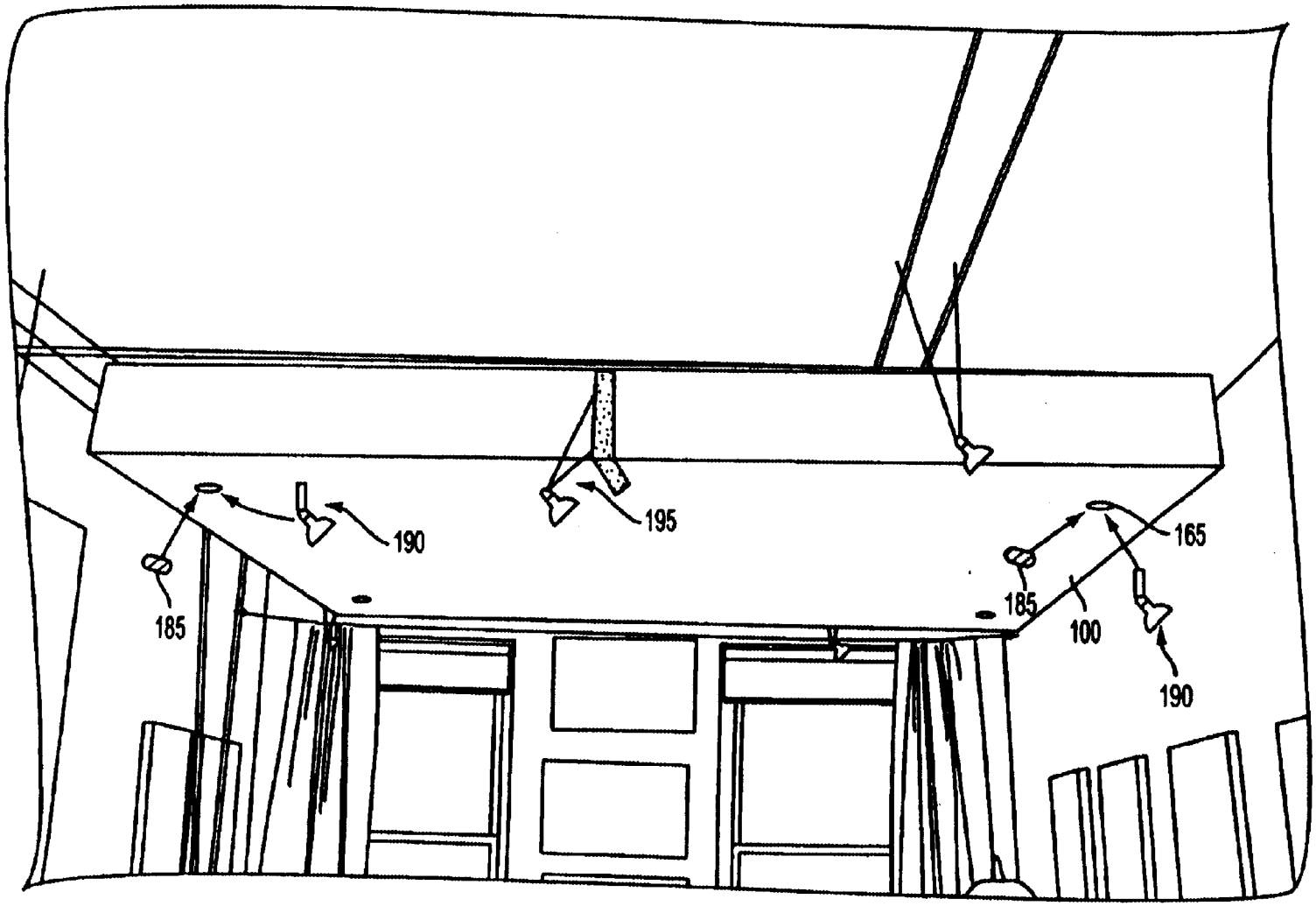
FIG. 3 is a diagram of a retractable bed system in the raised configuration with the legs removed according to an embodiment of the invention.

FIG. 3 is an illustration of retractable bed system 100 in the raised configuration with the legs 165 removed or retracted. The reader should comprehend from this illustration that the result harmonizes beautifully with a modern design aesthetic.

Figure 4:
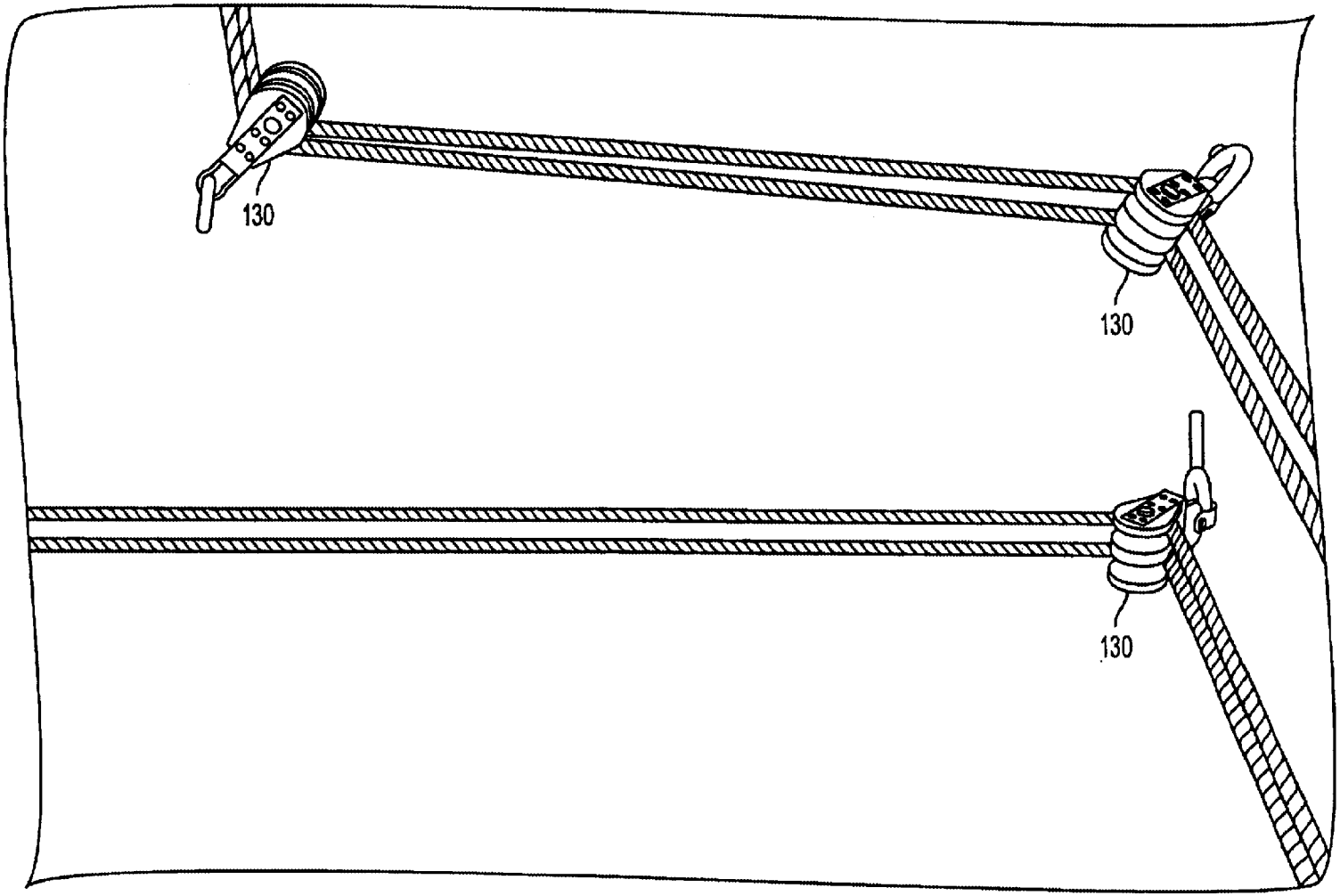
FIG. 4 is a diagram of blocks and support lines which can be employed according to an embodiment of the retractable bed system.

FIG. 4 is an illustration of a portion of the block assembly including double blocks 130 mounted to the ceiling (e.g. using eye hooks).

Figure 5:
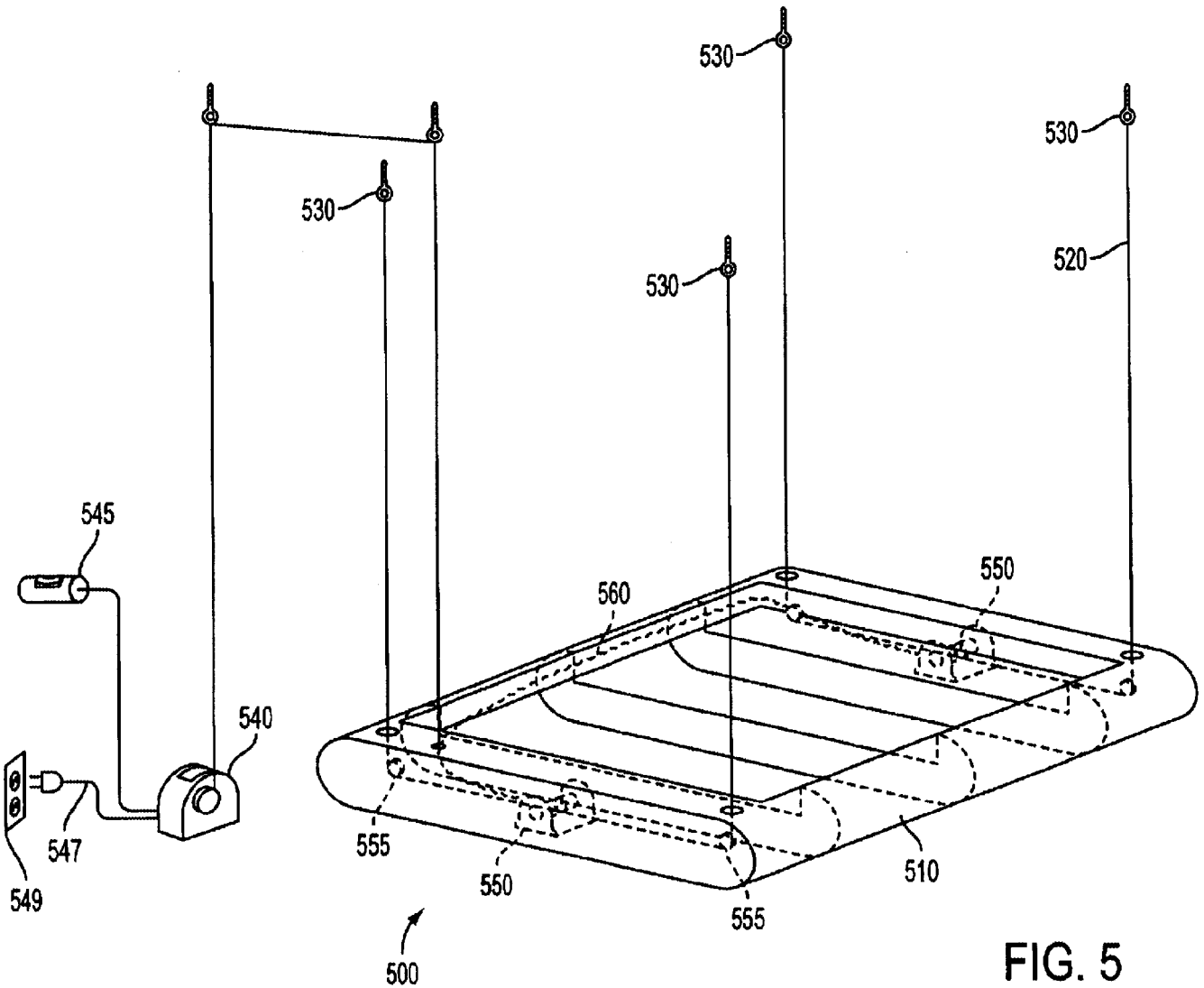
FIG. 5 is a diagram of an alternative embodiment of the retractable bed system employing a raising/lowering device (s) that moves with the bed.

FIG. 5 provides an alternative embodiment of a retractable bed system 500 using raising and lowering means that are integrated into, and which move with, the frame. According to this embodiment, retractable bed system 500 includes frame 510; at least one raising/lowering means 550; support lines 520; internal blocks 555; power line 560; eye hooks 530; self-winding power cord 540; remote control unit 545; plug 547; and outlet 549.

The general operation of retractable bed system 500 is as follows. Raising/lowering means 550, under the control of remote control device 545, takes in or extends support lines 520 in order to raise or lower frame 110. Raising/lowering means 550 is attached to and integrated with frame 510 such that it moves with frame 110 as it is raised/lowered. The load associated with frame 110 and associate structure is maintained using support lines 520 routed to raising/lowering means 550 using a block structure comprising blocks 555 which are integrated with, and which therefore move with, frame 110 as it is raised/lowered. Power is fed to raising/lowering means 550 using power line 560. Power line 560 may be paid out/retracted using a self-winding power cord 540 device.

Frame 510, like frame 110 of FIG. 1, may be a conventional frame that is adapted for the present invention. Preferably, however, frame 510 has an internal cavity designed to accommodate the internally integrated raising/lowering means 550, blocks 555, and power line 560, of this embodiment of the invention. Frame 510 may have oval-shaped ends that readily accommodate the internally-integrated components of the invention and which provide an attractive design feature. Frame 510 may be a custom built frame designed to be light weight and to support a specific manufactured mattress.

Raising/lowering means 550 may comprise electric motors. Preferably, raising/lowering means 550 comprises two motors, one for each end of the frame 510, which are synchronized to ensure the frame 510 is raised or lowered uniformly. According to another approach, a single motor 550 could be employed with a drive shaft (not shown) that would extend the length of the frame. This would ensure synchronized raising/lowering of the ends of the bed and would be cost effective and light weight.

Blocks 555 may comprise single blocks as discussed above for the single blocks of FIG. 1.

Support lines 520 may comprise any of the lines discussed above for FIG. 1. Preferably, support lines 520 comprise high strength nautical lines constructed of metal.

Eye hooks 530 may comprise the eye hooks or similar means for coupling support lines to the ceiling as discussed for FIG. 1.

Self-winding power cord 540 pays out and takes in the power line 560 as the bed is being lowered or raised. According to another approach, the power could be tied into (integrated with) lines 520 so that the power cord 540 functionality would be integrated into the frame 510 rather than being outside of it.

Plug 547 provides power to the system by connection to electrical outlet 549.

Figure 6:
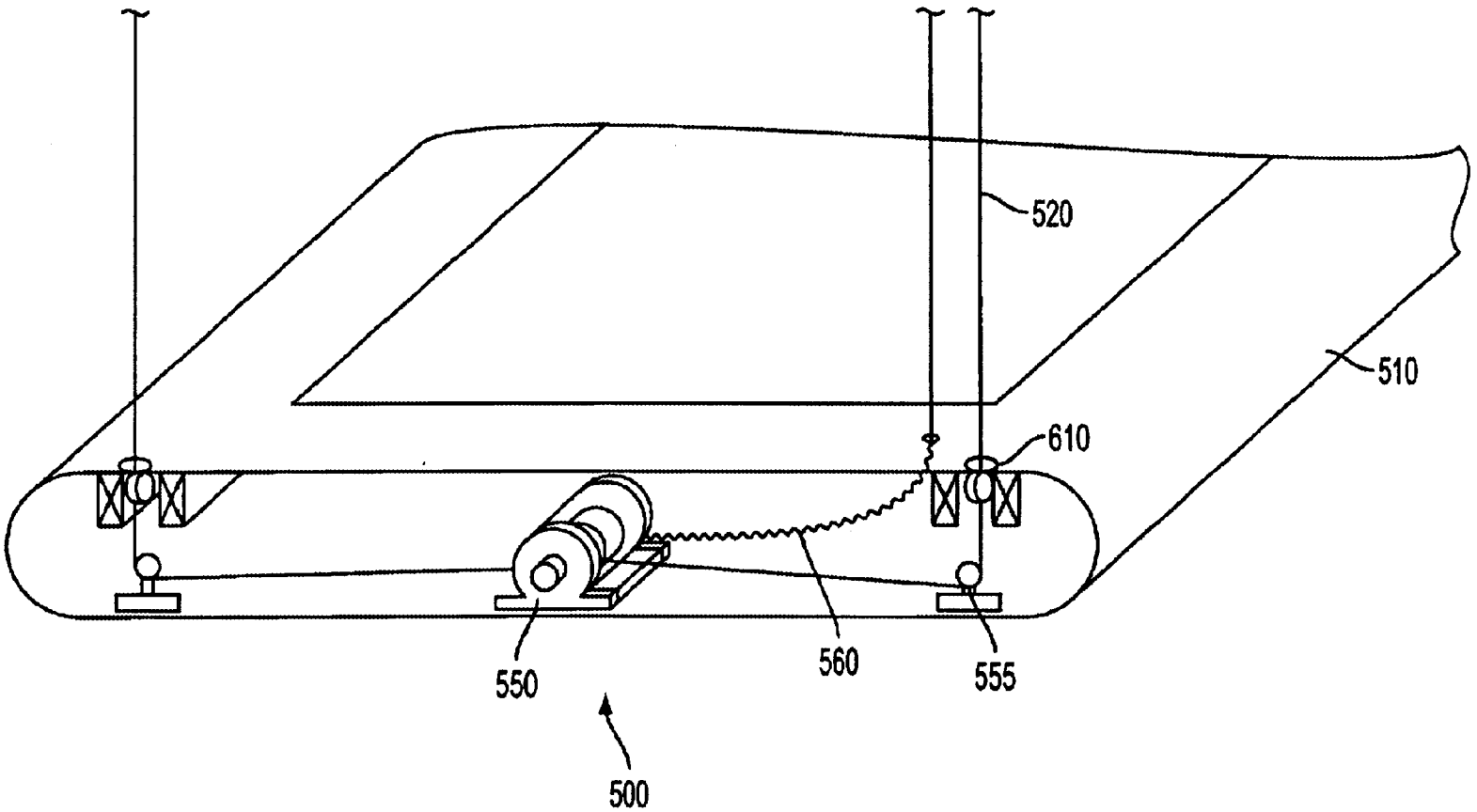
FIG. 6 is a diagram providing a sectional view of the alternative embodiment of the retractable bed system.

FIG. 6 is a diagram providing a sectional view of the alternative embodiment of the retractable bed system. FIG.

6 includes raising/lowering means 550, which may comprise an electric winch; power line 560 (which may be fed to raising/lowering means 550 through an orifice in frame 510); support lines 520; and flush mated blocks 610 for routing the support lines 520 to blocks 555.

Figure 7:
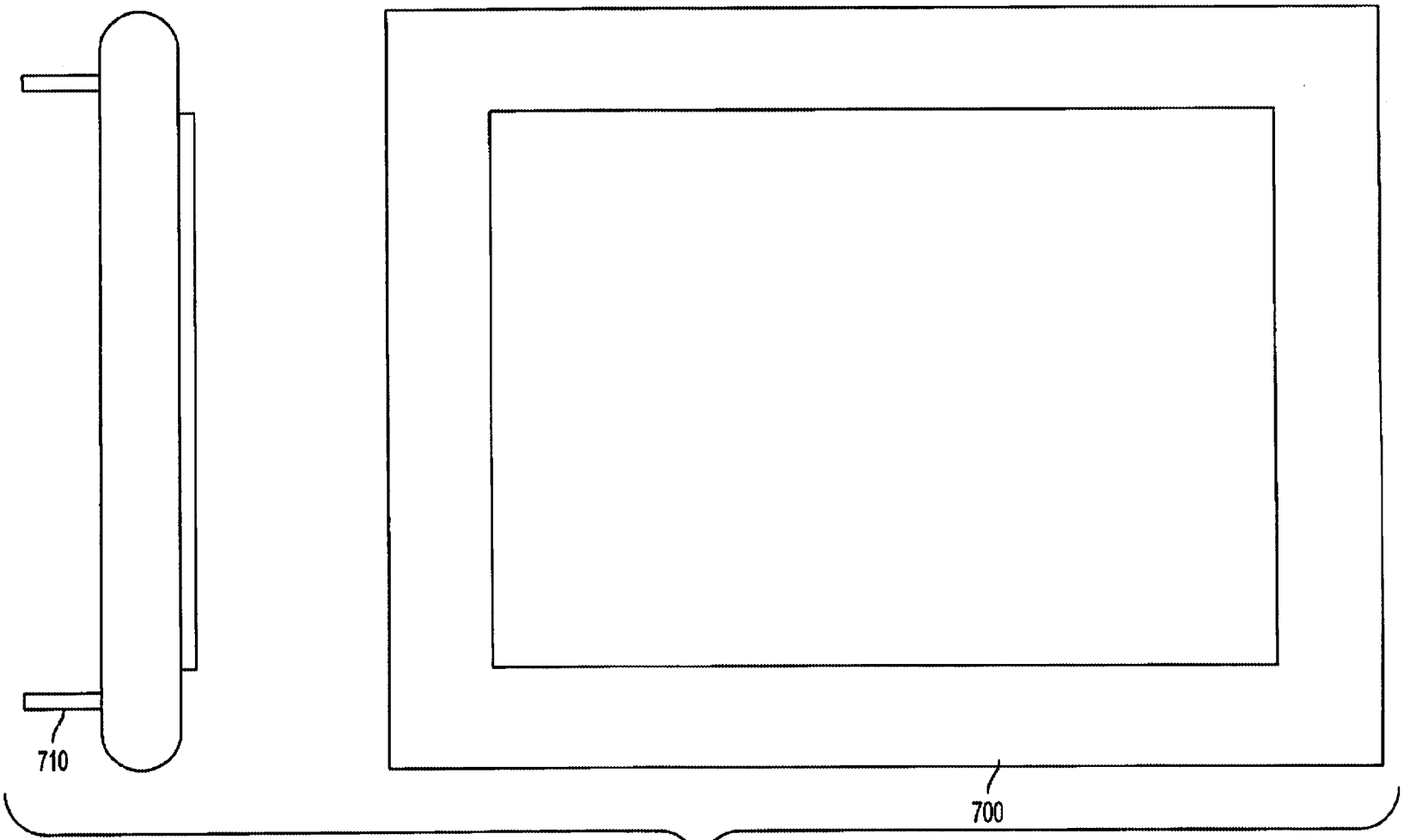
FIG. 7 is a diagram providing a top view and front view of the alternative embodiment of the retractable bed system.

FIG. 7 is a diagram providing a top view and front view of the alternative embodiment of the retractable bed system, including rectangular frame 700 and legs 710. Legs 710 may be removable or retractable (or even fixably attached), as discussed above regarding FIG. 1.

Figure 8:
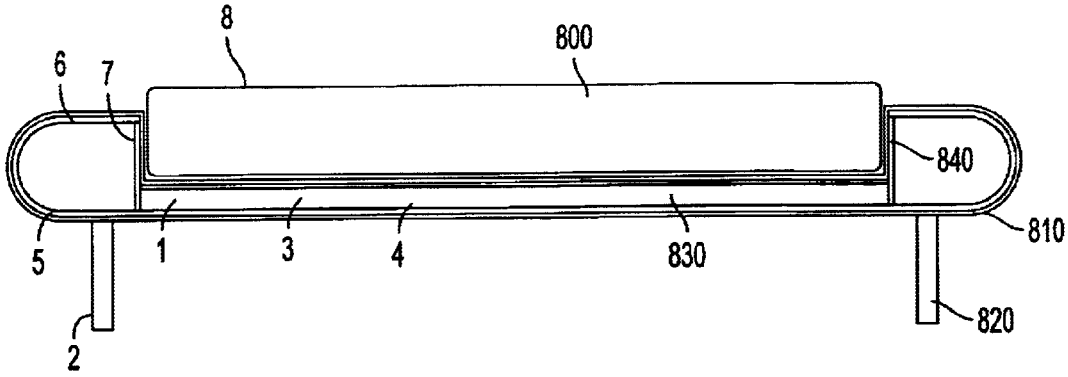
FIG. 8 is a diagram providing a front view of the alternative embodiment of the retractable bed system.

FIG. 8 is a diagram providing a front view of the alternative embodiment of the retractable bed system, including bed (mattress) 800; a frame 810 comprising side supports 840 and bottom support 830; and legs 820.

Figure 9:
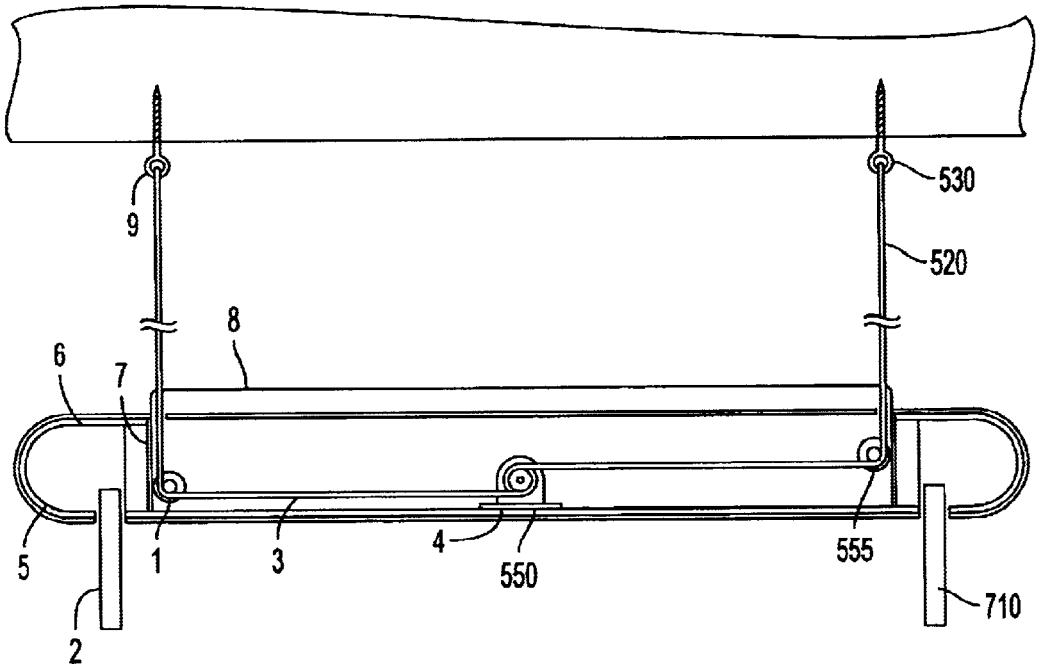
FIG. 9 is a diagram providing a sectional front view of the alternative embodiment of the retractable bed system.

FIG. 9 is a diagram providing a sectional front view of the alternative embodiment of the retractable bed system, including some of the aforementioned components.

Embodiments of systems and methods for have been described. In the foregoing description, for purposes of explanation, numerous specific details are set forth to provide a thorough understanding of the present invention. It will be appreciated, however, by one skilled in the art that the present invention may be practiced without these specific details. Additionally, in the foregoing detailed description, the present invention has been described with reference to specific exemplary embodiments. These specific embodiments are intended to exemplary only and, accordingly, the present specification and figures are to be regarded as illustrative rather than restrictive.

What is claimed is:

1. A retractable bed, comprising:

a bed comprising a frame for holding a mattress, said bed being coupled to a ceiling through support lines;

means for raising and lowering said bed through vertical displacement;

wherein the means for raising and lowering comprises at least one motor that is:

(a) physically coupled to the bed so that it moves with the bed as the bed is raised and lowered, the at least one motor being located at an end of the bed and above the bottom plane of the bed; or (b) physically located away from the bed so that it does not move with the bed as the bed is raised and lowered, the at least one motor being coupled to the floor or a wall, and not to the ceiling;

wherein said bed will come into contact with a floor when the bed is in the lowered configuration thereby permitting a person to sleep on the bed;

wherein said bed will be raised to a vertical location adjacent to the ceiling when the bed is in the raised configuration thereby permitting a person to pass under the bed;

wherein said means for raising and lowering said bed is automated; and wherein said bed can be changed from the lowered configuration to the raised configuration through vertical displacement without any rotational displacement of the frame.

2. The retractable bed of claim 1, wherein the means for raising and lowering further comprises a block assembly coupled to load bearing lines.

3. The retractable bed of claim 2, wherein said block assembly comprises a plurality of double blocks and a plurality of single blocks.

4. The retractable bed of claim 2, wherein said block assembly comprises at least four blocks, each of which in the vertical plane is located above the bed, and each of which in the horizontal plane is closest to a corner of the bed thereby supporting the load at that corner, wherein the at least four blocks do not move with the bed as it is raised and lowered.

5. The retractable bed of claim 2, wherein said block assembly comprises at least four blocks, each of which in the horizontal plane is closest to a corner of the bed, wherein the at least four blocks move with the bed as it is raised and lowered.

6. The retractable bed of claim 1, wherein the at least one motor is housed within the frame, thereby hiding the at least one motor.

7. The retractable bed of claim 1, wherein said at least one motor comprises two synchronized motors, one motor being located at one end of the bed, and the other motor being located at the other end of the bed.

8. A retractable bed, comprising:

a bed comprising a frame for holding a mattress, and legs or support blocks, said bed being coupled to a ceiling through support lines;

at least one motor for raising and lowering said bed through vertical displacement, the at least one motor being;

(a) physically coupled to the bed so that it moves with the bed as the bed is raised and lowered, the at least one motor being located at an end of the bed and above the bottom plane of the bed; or (b) physically located away from the bed so that it does not move with the bed as the bed is raised and lowered, the at least one motor being coupled to the floor or a wall, and not to the ceiling;

wherein said bed will come into contact with a floor when the bed is in the lowered configuration thereby permitting a person to sleep on the bed;

wherein said bed will be raised to a vertical location adjacent to the ceiling when the bed is in the raised configuration thereby permitting a person to pass under the bed;

wherein said bed can be changed from the lowered configuration to the raised configuration through vertical displacement without any rotational displacement of the frame.

9. The retractable bed of claim 8, wherein said at least one motor is operatively coupled to a remote control unit.

10. The retractable bed of claim 8, wherein said at least one motor is adapted to allow a maximum amount of displacement so as to avoid damage to the ceiling or the floor.

11. The retractable bed of claim 8, further comprising at least one sensor for determining when the bed is in the lowered configuration based on measurement of the position of the bed.

12. The retractable bed of claim 8, further comprising at least one sensor for determining when the bed is in the raised configuration based on measurement of the position of the bed.

13. The retractable bed of claim 11, further comprising an output device for outputting a visual or acoustic indicia that the bed is in the lowered configuration.

14. The retractable bed of claim 12, further comprising an output device for outputting a visual or acoustic indicia that the bed is in the raised configuration.

15. The retractable bed of claim 8, wherein said legs or support blocks are removable.

16. The retractable bed of claim 15, wherein the legs or support blocks are threadably removable.

17. The retractable bed of claim 15, further comprising covers for hiding orifices that are exposed when the legs or support blocks are removed.

18. The retractable bed of claim 15, further comprising a light fixture which can be inserted into an orifice when a leg or support block is removed.

19. The retractable bed of claim 8, wherein said legs or support blocks can be automatically extended or retracted.

20. The retractable bed of claim 19, further comprising a plurality of motors integrated with said frame for extending and retracting said legs or support blocks.

21. The retractable bed of claim 8, further comprising a light fixture attached to the frame when the bed is in the raised position.

22. The retractable bed of claim 21, wherein said light fixture is permanently attached to the bottom of the frame.

23. The retractable bed of claim 21, wherein the light fixture is removably attached to the frame.

* * * * *